United States Patent [19]

Yamasita et al.

[11] 3,955,907

[45] May 11, 1976

[54] APPARATUS FOR MOLDING LAYERED CONCRETE SLABS

[76] Inventors: Keniti Yamasita, 3-34, Nishimachi 2-chome, Gamou, Koshigaya, Saitamo; Zyozi Yamasita, 21-17, Sugano-cho 2-chome, Ichikawa, Chiba, both of Japan

[22] Filed: May 28, 1974

[21] Appl. No.: 473,917

Related U.S. Application Data

[60] Division of Ser. No. 311,786, Dec. 4, 1972, abandoned, which is a continuation of Ser. No. 94,750, Dec. 3, 1970, abandoned.

[52] U.S. Cl. ..... 425/130; 264/157; 425/260

[51] Int. Cl.[2] ..... B28B 1/16; B28B 13/02

[58] Field of Search ..... 264/245, 256, 157, 240; 214/16 R, 17 C; 425/130, 134, 260, 257, 132

[56] References Cited

UNITED STATES PATENTS

| | | | |
|---|---|---|---|
| 1,594,310 | 7/1926 | Long et al. | 264/69 |
| 1,616,547 | 2/1927 | Pontoppidan | 214/17 CA |
| 1,768,922 | 7/1930 | Oliver | 264/157 |
| 2,124,759 | 7/1938 | Bradbyer | 264/157 |
| 2,552,090 | 5/1951 | Eusner | 425/130 |
| 3,416,676 | 12/1968 | Nolin | 214/17 CA |
| 3,425,105 | 2/1969 | Gulde | 264/256 |
| 3,426,112 | 2/1969 | Taylor-Smith | 264/71 |

OTHER PUBLICATIONS

Anon., Stephens-Adamson Co., Catalog No. 25 (Aurora, Ill.), 1916, pp. 272, 274 & 275.

*Primary Examiner*—Willard E. Hoag
*Attorney, Agent, or Firm*—Kurt Kelman

[57] ABSTRACT

Apparatus for depositing different sized aggregate in separate portions of a mold to produce a molded concrete slab or block having three adjacent layers arranged with vertical interfaces.

1 Claim, 5 Drawing Figures

INVENTORS
KENITI YAMASITA
ZYOZI YAMASITA
BY
Kurt Kelman

INVENTOR.
KENITI YAMASITA
ZYOZI YAMASITA
BY
Kurt Kelman
AGENT

APPARATUS FOR MOLDING LAYERED CONCRETE SLABS

This is a division of our U.S. Pat. application Ser. No. 311,786 filed Dec. 4, 1972, which was a continuation of Ser. No. 94,750, filed Dec. 3, 1970, both now being abandoned.

This invention relates to an apparatus for manufacturing molded slabs from which concrete blocks having a rough decorative surface are made.

The practice of forming a large concrete molded slab, splitting it into separate blocks and using the concrete blocks in buildings, reinforced embankments, earth-retaining walls and other structures, with the rough split surface of each block serving as a decorative surface, is already known to the art. The aforementioned concrete blocks are manufactured by splitting a molded slab which is formed throughout of a single material. However, since splitting proceeds from portions of lower internal stress to portions of higher internal stress, the molded slab is not necessarily dissected into two exactly equal halves when the blade is lowered down in the middle of the slab in an effort to split it into two equal halves. Consequently, there frequently occurs uneven splitting which yields two blocks extremely different in shape from each other and inevitably gives rise to a high rate of rejects. On some occasions, an effort is made to improve the decorative effect of the rough decorative surface by means of a coloring agent or fine glittering powder. In this case, the conventional manufacturing method has the molded slab formed by using a single material throughout and, therefore, it becomes necessary for the decorative additive such as coloring agent or fine glittering powder to be admixed into the material in advance. This means that the amount of decorative additive thus required will be quite large, notwithstanding the plain fact that it is sufficient for the decorative additive to appear only on the rough decorative surface.

The present invention provides an apparatus for manufacturing a molded slab, which has one first layer through which the blade will pass at the time of splitting and two second layers each of which will form a block proper, with the first layer positioned between the two second layers and formed integrally therewith by causing the adjoining layers to harden together in a fused state, so that the finished slab may be split through the aforementioned first layer. This permits the splitting of the molded slab into separate blocks each possessed of a rough decorative surface exclusively through the aforementioned first layer thereby precluding the possibility of uneven splitting and rejectable products.

It also permits markedly decreasing the amount of decorative additive used by making it sufficient for the additive to be admixed into only the material for forming the first layer, with the result that even an expensive decorative additive will not affect the price of the product greatly.

The aforementioned objects and other objects of the present invention will become apparent from the description which is given hereinafter on the basis of the accompanying drawing.

Figure 1:
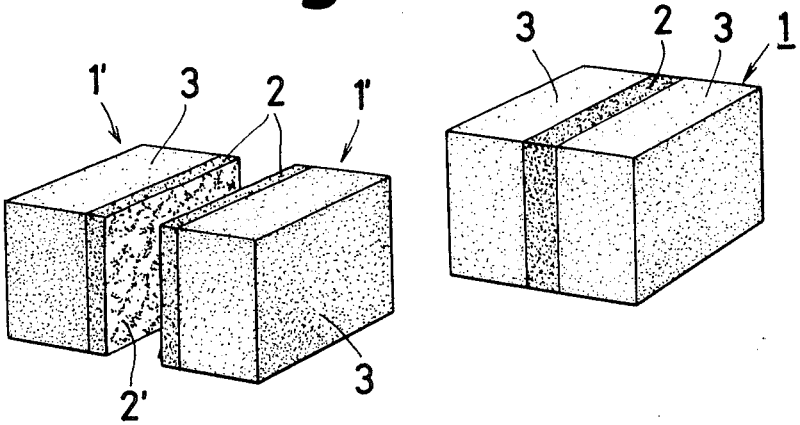
FIG. 1 is a perspective view illustrating constructional blocks manufactured by this invention and a molded slab preparatory to being split into blocks.
Figure 2:
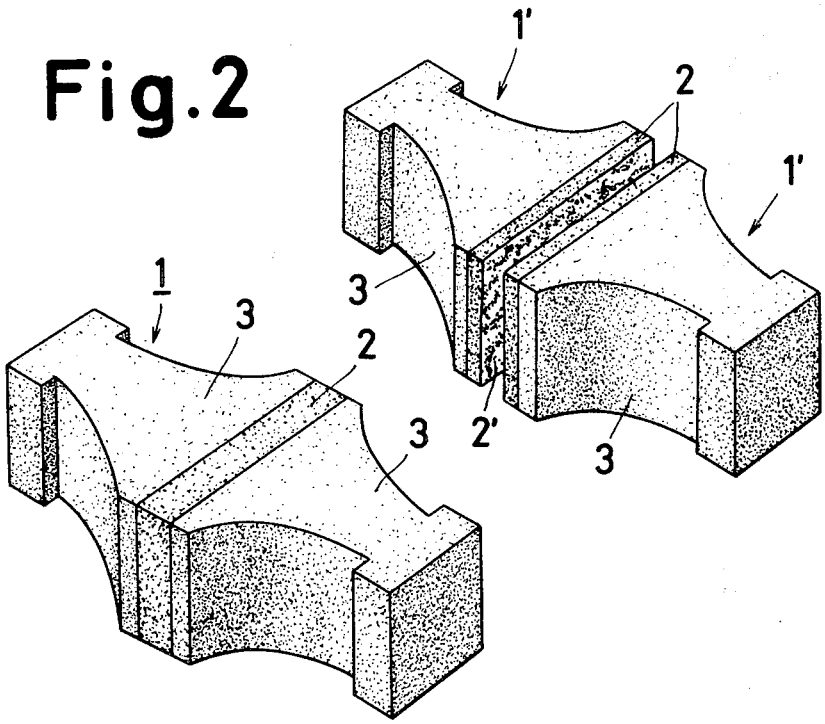
FIG. 2 is a perspective view illustrating constructional blocks manufactured by this invention and a molded slab preparatory to being split into blocks.
Figure 3:
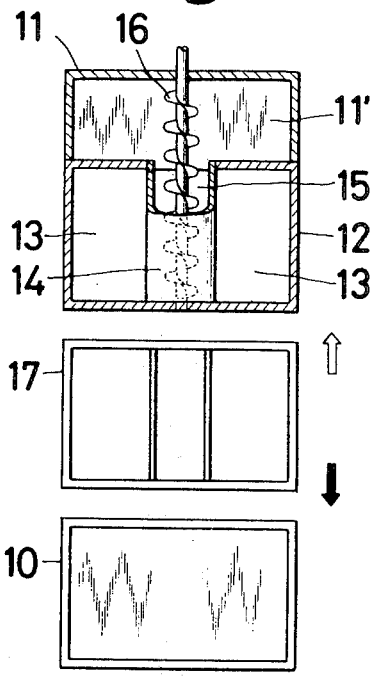
FIG. 3 represents a mold for forming a molded slab according to the present invention and a partially cross-sectional view illustrating the plan layout of a raw material-feeding member.
Figure 4:
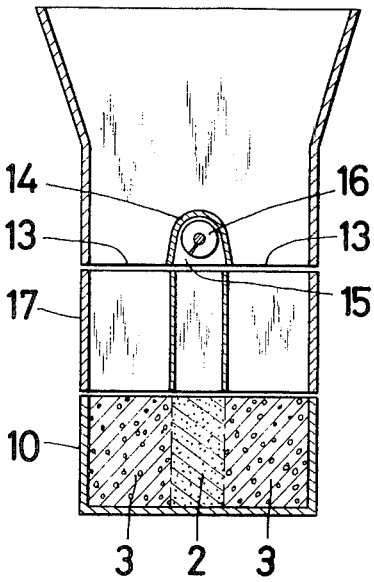
FIG. 4 is a cross-sectional view illustrating the front-elevation layout of this member wherein the mold is packed with the filling material.
Figure 5:
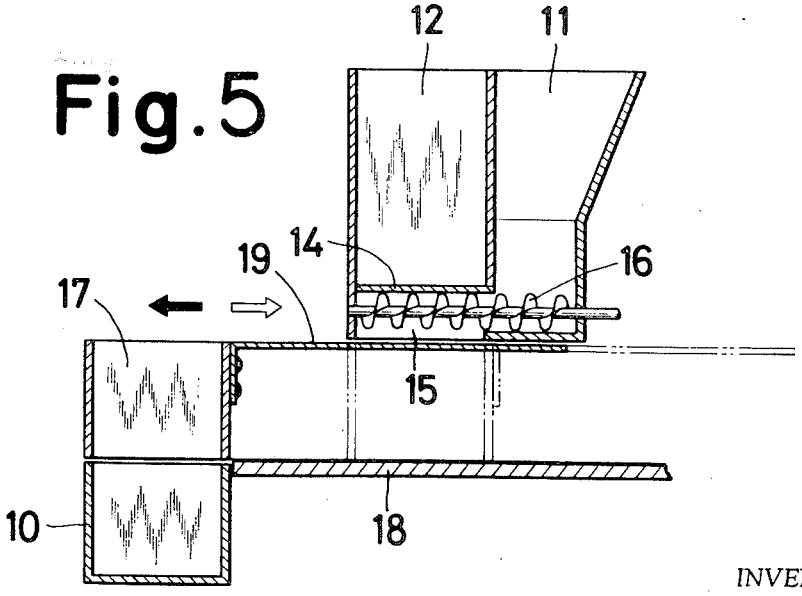
FIG. 5 is a cross-sectional view illustrating the side-elevation layout of the same member.

Referring to FIG. 1 and FIG. 2, molded slab 1 is a shaped article having a thin first layer 2 hardened integrally with two second layers 3 and 3 each adjoining the said first layer 2 on opposite sides. Block 1' is manufactured by passing a blade through the first layer 2 and splitting the molded slab along a plane falling inside the first layer 2. The block 1' is illustrated to possess a rough surface 2' as a consequence.

Of the ingredients of the material for the first layer, the gravel or man-made gravel used as aggregate is so selected that its diameter will fall within the range of from 8 to 5 mm. When this layer is colored by admixing a pigment therein, a clear color can be conferred thereon by using cement or white cement.

Of the ingredients of the material for the second layer, the gravel to be used as an aggregate may be of any type used ordinarily in concrete. The gravel in this case, unlike the gravel to be used for the first layer, need not be limited in diameter.

Typical mixtures of ingredients for the first and second layers are shown in the following table.

| | | (In kg) | | |
|---|---|---|---|---|
| | | Mixture I | Mixture II | Mixture III |
| First Layer | Gravel (grain size 8 - 5 mm) | 1310 | 0 | 1250 |
| | Man-made light-weight aggregate | 0 | 190 | 0 |
| | Sand | 395 | 360 | 740 |
| | Cement | 0 | 0 | 284 |
| | White cement | 328 | 100 | 0 |
| | Pigment | 0 | 0.8 (green) | 0.6 (blue) |
| | Fine glittering powder | 262 | 0 | 0 |
| | Water/cement ratio (%) | 35% | 38% | 40% |
| Second Layer | Gravel (grain size 25 - 8 mm) | 1015 | | 500 |
| | Man-made light-weight aggregate | 0 | 190 | 0 |
| | Sand | 1015 | 360 | 300 |
| | Cement | 245 | 100 | 100 |
| | Water/cement ratio (%) | 40% | 35% | 38% |

-continued

| | Mixture I | Mixture II | Mixture III |
|---|---|---|---|
| | | (In kg) | |
| Appearance of rough decorative surface | Granite | Oyaseki in green color | Granite in blue color |

Practically, it is sufficient for the first layer 2 to have a thickness of about 5 cm. Accordingly, the amount of the material to be used in forming the first layer 2 is extremely small as compared with that of the material used in forming the second layers 3 and 3 and, as a consequence, the amount of decorative additive to be mixed in the material for forming only one first layer is negligibly small. Thus, use of a very expensive decorative additive will hardly affect the price of the product. When the materials packed in the section 8 of the mold 4 are sufficiently hardened to complete a molded slab 1, the slab is extracted from the mold and split by passing the blade through the first layer 2.

The molded slab is, as mentioned above, a shaped article all of concrete produced by causing the second layers 3 and 3 to be brought into union with the first layer 2 one on each side thereof and hardened integrally therewith simultaneously, so that it is a body of uniform age. Therefore, the first layer and the second layers are not separate from each other either in point of material or strength. The only difference between them lies in the fact that the first layer is formed by selectively using gravel of a smaller diameter and is, therefore, more amenable to splitting than the second layers. Accordingly, the splitting is accomplished exclusively within the first layer and the plane of dissection will not run into the second layers. This means that the molded slab hereof will be perfectly free from the possibility of uneven splitting and consequent occurrence of rejectable products.

In order that the material for the first layer and the material for the second layers may be packed inside the mold 10, a second layer on each side of the first layer, there is provided side by side a first hopper 11 for holding the material for the first layer and a second hopper 12 for holding the material for the second layer. A pair of second openings 13 and 13 are disposed at a distance from each other at the lower end of the second hopper 12 and a tunnel-shaped wall 14 bridges the space between the second openings 13 and 13 so that the material for the second layer will fall through the openings 13 and 13.

The first hopper 11 has a bottom 11' at which first hopper 11 communicates with one end of a chamber 15 which has the said tunnel-shaped wall 14 as its upper wall and is opened at the bottom so as to form the first opening. Thus, the material for the first layer will enter the chamber 15 and fall through the first opening formed at the lower end. For the purpose of propelling the material from the bottom of the first hopper 11 to the chamber 15, there is provided a screw feeder 16.

The shape of the mold 10 is substantially the same in plan view as that of the lower end of the second hopper 12. Therefore, if the lower end of the second hopper 12 is closed with a suitable means such as a shutter, the mold 10 is positioned directly below the second hopper and the lower end of the second hopper is subsequently opened, the material within the second hopper 12 will fall through the openings 13 and 13 and the material within the first hopper 11 will simultaneously fall through the first opening at the lower end of the chamber 15, with the consequence that the mold 10 will be packed with the material for forming the first layer 2 and the material for forming the second layers 3 and 3, the latter on each side of the former. On completion of the filling, it is sufficient to close the lower end of the second hopper 12, move the mold 10 from under the second hopper 12 and then allow the materials now deposited in the mold to harden into a molded slab.

When it is convenient to have the mold 10 and the second hopper 12 positioned separately from each other, an auxiliary frame 17 which is open at both its upper and lower ends and which permits the upper plane thereof to come into connection with the lower end of the second hopper 12 at one limit of the travelling range thereof and the lower plane thereof to come into connection with the upper end of the mold 10 at the other limit or the travelling range thereof is provided in such way that it will be moved continuously on the bed member 18 and the upper side of the mold 10. By this means, the auxiliary frame 17 may be moved over the bed member 18 to a position directly below the second hopper 12 to receive temporarily the materials falling through the openings 13 and 13 and the chamber 15 and subsequently moved to a position directly above the mold 10 where the received materials are discharged from the auxiliary frame 17 into the mold for final filling. In this case, it becomes necessary to provide a shutter member 19 which serves to close the openings 13 and 13 and the opening of the chamber 15 while the auxiliary frame 17 is in motion to and from the mold 10. This shutter member 19 may be supported by the auxiliary frame 17. The shape of the auxiliary frame 17 must of course be substantially equal, in plan view, to the mold 10 and the lower end of the second hopper 12. Thus, the auxiliary frame 17 enables the mold 10 to be filled with the material for forming the first layer 2 and the material for forming the second layers 3 and 3, the latter on each side of the former. The auxiliary frame 17 is then returned to directly below the second hopper to receive the materials which are to be packed in the next mold, while the materials contained in the mold 10 harden without any further treatment into a molded slab. After hardening, the molded slab is removed from the mold 10 and then split by passing the blade through the first layer 2.

Better results are obtained when the molded slab removed from the mold 4 or 10 is split before it has reached its full hardness.

The present invention makes it possible for concrete blocks having a rough decorative surface to be manufactured in shapes suitable for any intended usage by making appropriate changes in the shape of layers 3 and 3. As long as the size of the rough decorative surface is the same, concrete blocks of two types differing in shape from each other can be manufactured simultaneously by conferring different shapes on the 2 second layers 3 and 3.

What is claimed is:

1. An apparatus for the manufacture of molded concrete slabs comprising in combination:

1. a first hopper for holding a relatively small-diameter concrete making material adapted to produce a decorative surface, the first hopper having
   a. a first portion for receiving the material and
   b. a tunnel-shaped second portion extending from the first hopper portion, the second hopper portion defining a first opening extending therealong,
2. a second hopper for holding a concrete making material of larger diameter than the material in the first hopper, the second hopper having
   a. a first portion adjacent the first portion of the first hopper and
   b. a second portion on each side of the tunnel-shaped portion of the first hopper, the second hopper portion defining two second openings extending alongside the first opening on each side thereof and being substantially wider and coplanar therewith,
3. a screw conveyor disposed in the tunnel-shaped second portion of the first hopper and arranged to convey the small-diameter concrete making material from the first portion of the first hopper into the second portion thereof whereby the material is delivered to the first opening, 4. a mold having an upper opening mating in area with the total area of the first and second openings in the hoppers,
5. an auxiliary frame having an upper and lower end,
   a. the frame ends having openings mating in area with that of the openings in the mold and in the hoppers, and the frame comprising
   b. two partitions defining a central portion for alignment with the tunnel-shaped second portion of the first hopper and two outer portions for alignment with the second openings in the second hopper,
6. a platform disposed to support the auxiliary frame movably between a first position wherein the portions of the frame are in alignment with the openings in the hopper and a second position wherein the portions of the frame are in alignment with the opening in the mold, and
7. a shutter member disposed to open the openings in the hoppers in the first position of the frame and to close the openings in the hoppers in the second position of the frame, the materials in the hoppers passing through the openings therein into the aligned portions of the auxiliary frame to fill the same when the shutter member opens the openings in the hoppers, and the materials in the portions of the auxiliary frame passing into the mold to fill the same while the shutter member closes the openings in the hoppers.

* * * * *